US006182847B1

(12) United States Patent
Shu

(10) Patent No.: US 6,182,847 B1
(45) Date of Patent: Feb. 6, 2001

(54) CONTAINER FOR GELATIN

(76) Inventor: Wu-Tu Shu, No. 3 Ying-Tsuo Lane Chao-An Li, Lu-Kang Chen, Changhwa Hsien (TW)

( * ) Notice: Under 35 U.S.C. 154(b), the term of this patent shall be extended for 0 days.

(21) Appl. No.: 09/520,960

(22) Filed: Mar. 8, 2000

(51) Int. Cl.[7] ..... B65D 21/00
(52) U.S. Cl. ..... 220/4.21; 220/4.25; 220/319
(58) Field of Search ..... 220/4.21, 4.24, 220/4.25, 4.27, 23.4, 23.83, 23.86, 319, 324

(56) References Cited

U.S. PATENT DOCUMENTS 1,921,015 * 8/1933 Young ..... 220/4.25 X
3,161,156 * 12/1964 Bartista et al. ..... 220/4.25 X
3,292,840 * 12/1966 Schmidt ..... 220/4.25
3,365,308 * 1/1968 Janicke ..... 220/4.21 X
4,728,003 * 3/1988 Davey ..... 220/319

* cited by examiner

*Primary Examiner*—Steven Pollard
(74) *Attorney, Agent, or Firm*—Bacon & Thomas

(57) ABSTRACT

A container for gelatin includes a cone-shaped first cup having a closed end and an open end. The diameter of the open end of the first cup is greater than that of the closed end of the first cup. A flange extends radially out from the periphery of the open end of the first cup. A cone-shaped second cup abuts the first cup and has a closed end and an open end. The diameter of the open end of the second cup is greater than that of the closed end. A flange extending radially out from the periphery of the open end of the second cup. The flange on the second cup flush abuts the flange on the first cup and has a diameter to the same as the flange on the first cup. A connector clamps and holds the first cup and the second cup together. The diameter of the connector is the same the diameter of the flange of the first cup.

2 Claims, 3 Drawing Sheets

CONTAINER FOR GELATIN

BACKGROUND OF THE INVENTION

1. Field of the Invention

The present invention relates to a container, and more particularly to a container for gelatin.

2. Description of Related Art

With reference to FIG. 5, a conventional container for gelatin in accordance with the prior art comprises a cup (40) that is cone-shaped and forms a recess (401) to hold gelatin. The container (40) includes a closed end and an open end. The diameter of the open end is greater than that of the closed end. The open end has a lip (402) extending radially out from the periphery.

Some gelatin producers have started to market gelatin with two flavors in one container to provide diversity. The bottom level of the recess (401) contains the first material (41) and the upper lever of recess (401) contains the second material (42). The first material (41) is a solid that does not liquefy again after solidifying even when reheated. The second material (42) is an ordinary gelatin whose state of liquidity depends on the ambient temperature. When making the double flavored gelatin, the producer first puts the melted first material (41) into the bottom of the recess (401) and then puts the second material (42) into the recess (401) on top of the first material (41) after the first material (41) has solidified.

The process as described is an ordinary technique used to make a double flavored gelatin. But it has several disadvantages.

1. It takes a long time. Waiting for the first material (41) to solidify is necessary before putting the second material (42) into the recess (401). This process is prolongs the time to make the double flavored gelatin.

2. It is not delicious. Because of the particularly solid state of the first material (41), it is different from ordinary gelatin.

3. The shape of the container (40) is monotonous. The lip (402) of the container (40) must be plane for eating easily. Consequently, the shape of the container (40) is limited and loses its market competitiveness.

The present invention has arisen to mitigate and/or obviate the disadvantages of the conventional container for gelatin.

SUMMARY OF THE INVENTION

In accordance with one aspect of the present invention, a container for gelatin is provided. The container for gelatin comprises a first cup and a second cup each having a flange extending radially out from the open end. The first and second cup can contain different material and be connected to each other by a connector to make a double flavored gelatin.

Further benefits and advantages of the present invention will become apparent after a careful reading of the detailed description with appropriate reference to the accompanying drawings.

DETAILED DESCRIPTION OF THE INVENTION

Figure 1:
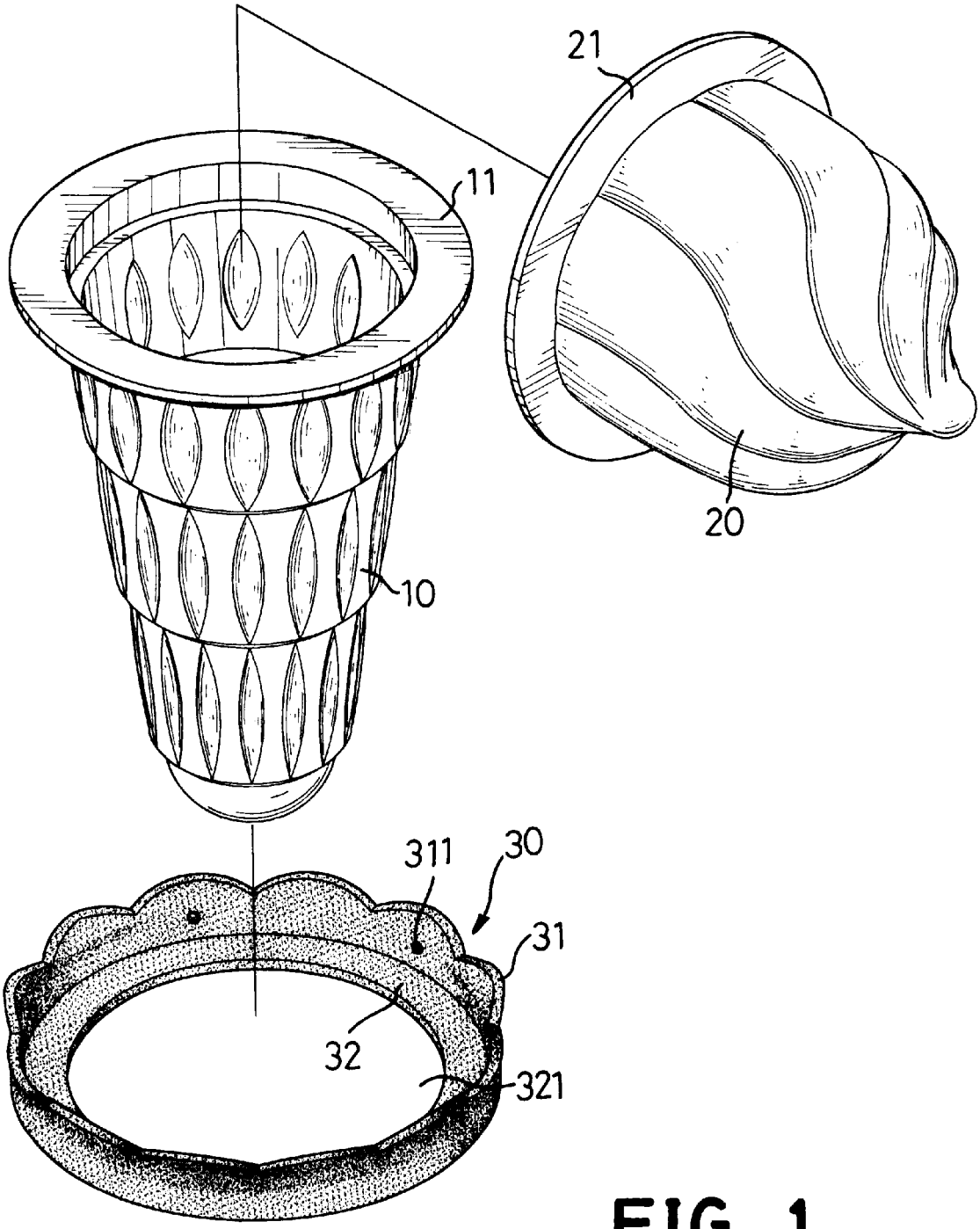
FIG. 1 is an exploded perspective view of a container for gelatin in accordance with the present invention.

Referring to the drawings and initially to FIG. 1, a container for gelatin in accordance with the present invention comprises a first cup (10) and a second cup (20). The first cup (10) and the second cup (20) are connected to each other by a connector (30).

The first cup (10) is cone-shaped and has a closed end and an open end. The diameter of the open end is greater than that of the closed end. The open end has a flange (11) extending radially out from the sides of the cone.

The second cup (20) is cone-shaped and also has a closed end and an open end. The diameter of the open end is greater than that of the closed end. The open end has a flange (21) extending radially out from the sides of the cone. The diameter of the flange (21) on the second cup (20) is that the same as the diameter of the flange (11) on the first cup (10).

The connector (30) clamps and holds the first cup (10) and the second cup (20) together. The connector (30) has a shoulder (32) extending radially inward that forms an opening (321) to allow the first cup (10) to extend through the opening (321) such that the flange (11) rests flush on the shoulder (32). The diametric dimensions of the connector (30) are the same as the flange (11) of the first cup (10) such that the flange (11) snugly abuts the shoulder (32) after the first cup (10) extending through the opening (321). A skirt (31) extends from the outer edge of the connector (30) toward the second cup (20). The inner wall of the skirt (31) has multiple boss (311) that extend radially inward. The distance between the lower portion of the boss (311) and the top portion of the shoulder (32) is equal to the total thickness of the flanges (11, 21) on the first and second cups (10, 20).

Figure 3:
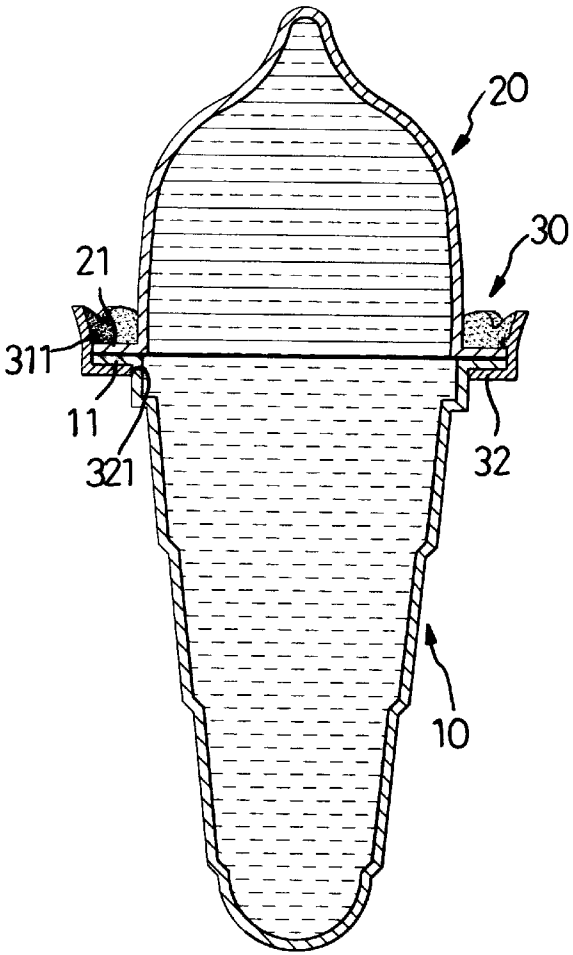
FIG. 3 is a cross sectional side plan view of the container for gelatin in FIG. 2.

With reference to FIGS. 1 and 3, to assemble the container, the first cup (10) extends through the opening (321) of the connector (30) from the side with the skirt (31) until the flange (11) flush abuts the shoulder (32) of the connector (30). Then the flange (21) on the second cup (20) is pressed against the flange (11) of the first cup (10) and is held in place by the bosses (311).

Figure 2:
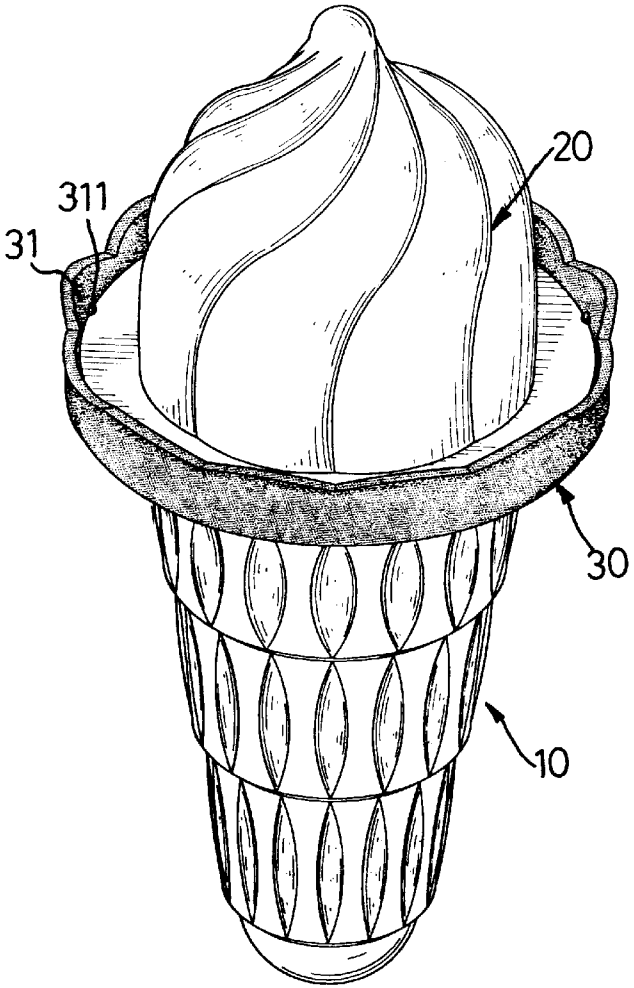
FIG. 2 is a perspective view of the container for gelatin in FIG. 1.
Figure 5:
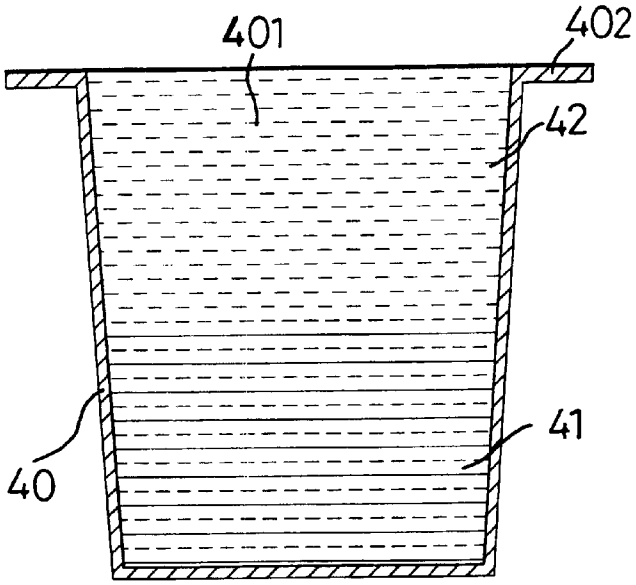
FIG. 5 PRIOR ART
FIG. 5 is a cross sectional side plan view of a conventional container for gelatin in accordance with the prior art.

Referring to FIGS. 1–3, when preparing a double flavored gelatin, liquid gelatin material is poured into the first cup (10) and the second cup (20) and allowed to solidify. The material in the first cup (10) is a different flavor from that contained in the second cup (20). Then after the liquid gelatin solidifies, the first cup (10) and the second cup (20) are pressed together and held in place by the connector (30).

Figure 4:
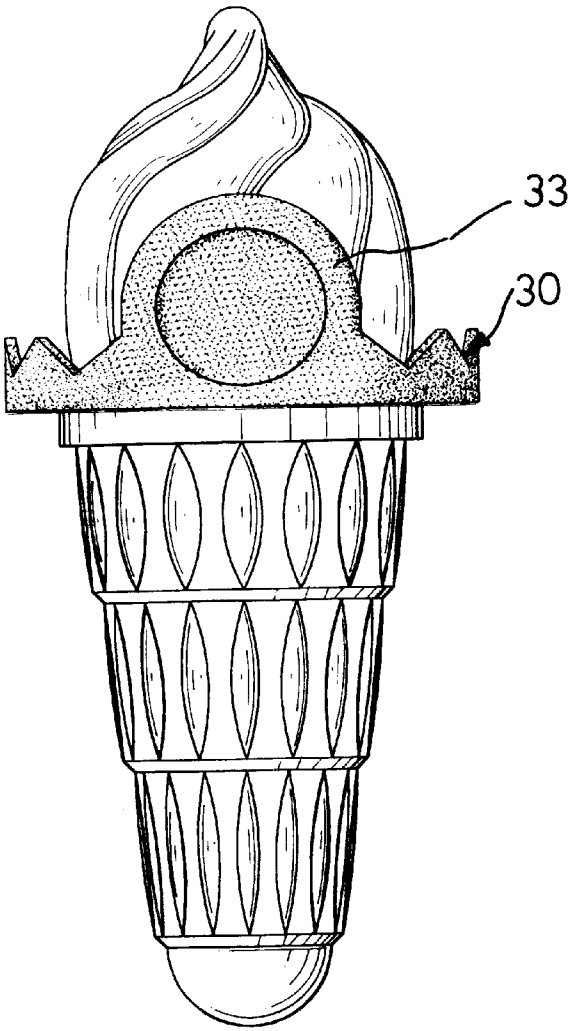
FIG. 4 is a front plan view of a second embodiment of a container for gelatin in accordance with the present invention.

With reference to FIG. 4, an indicating plate (33) extends from the skirt (31) of the connector (30). The indicating plate (33) can indicate the flavor of the gelatin or the brand of the producer.

The container for gelatin in accordance with the present invention as described above has several advantages as follow.

1. It shortens the time to produce the double flavored gelatin. The different flavored liquid gelatin is respectively poured into the first cup and the second cup at the same time. No waiting time for the first material to solidify is required.

2. The gelatin made by the present invention is more delicious. The first cup and the second cup are pressed together and held in place by the connector so the bad taste associated with the artificially hardened gelatin is unnecessary and makes the gelatin taste good.

3. The shape of the connector can be varied as desired. The skirt of the connector can be made into many shapes such as animals, cartoon characters or any other interesting object.

Although the invention has been explained in relation to its preferred embodiment, it is to be understood that many other possible modifications and variations can be made without departing from the spirit and scope of the invention as hereinafter claimed.

What is claimed is:

1. A container for gelatin comprising:

a cone-shaped first cup having a closed end and an open end, the diameter of said open end of said first cup being greater than that of said closed end of said first cup;

a flange extending radially out from the periphery of said open end of said first cup;

a cone-shaped second cup flush abutting said first cup, said second cup having a closed end and an open end, the diameter of said open end of said second cup being greater than that of said closed end of said second cup;

a flange extending radially out from the periphery of said open end of said second cup, said flange of said second cup flush abutting said flange of said first cup and having a diameter the same as that of said flange of said first cup;

a connector clamping and holding said first cup and second cup together, the diametric dimensions of said connector being the same as the dimensions of said flange of said first cup;

a shoulder extending radially inward from said connector and forming an opening to allow said first cup to extend therethrough, said flange of said first cup flush abutting said shoulder after said first cup extending through said opening; and a skirt extending from the outer edge of said connector and toward said second cup, said skirt including an internal wall having multiple boss extending radially inward, the distance between the lower portion of said boss and the top portion of said shoulder being equal to the total thickness of said flanges of said first and second cups.

2. The container for gelatin as claimed in claim 1, wherein said skirt includes an indicating plate extending therefrom.

* * * * *